US006006940A

United States Patent [19]

Lundin

[11] Patent Number: 6,006,940

[45] Date of Patent: Dec. 28, 1999

[54] PACKAGE WITH A CLOSING DEVICE

[76] Inventor: Lars Lundin, Sibyllegatan 52 B, Stockholm, Sweden, 114 43

[21] Appl. No.: 09/147,533

[22] PCT Filed: Jun. 6, 1997

[86] PCT No.: PCT/SE97/00996

§ 371 Date: Jan. 15, 1999

§ 102(e) Date: Jan. 15, 1999

[87] PCT Pub. No.: WO98/02364

PCT Pub. Date: Jan. 22, 1998

[30] Foreign Application Priority Data

Jul. 15, 1996 [SE] Sweden ..... 9602783

[51] Int. Cl.[6] ..... B65D 51/16

[52] U.S. Cl. ..... 220/256; 220/256; 220/259

[58] Field of Search ..... 220/256, 23.86, 220/27.8, 259

[56] References Cited

U.S. PATENT DOCUMENTS

| | | | |
|---|---|---|---|
| 2,535,455 | 12/1950 | Reilly | 220/36 |
| 4,551,311 | 11/1985 | Lorenz | 220/256 |
| 4,917,131 | 4/1990 | Contreras, Sr. | 220/256 |
| 5,176,272 | 1/1993 | Ryan | 220/4.23 |
| 5,576,929 | 11/1996 | Uchiyama et al. | 220/256 |
| 5,657,891 | 8/1997 | Bilani et al. | 220/256 |

FOREIGN PATENT DOCUMENTS

| | | |
|---|---|---|
| 2203359 | 5/1974 | France . |
| 538 967 | 8/1973 | Switzerland . |
| 95/20527 | 8/1995 | WIPO . |

*Primary Examiner*—Joseph M. Moy
*Attorney, Agent, or Firm*—Jacobson, Price, Holman & Stern, PLLC

[57] ABSTRACT

A packaging unit includes an article supporting surface (1) which is joined to a cupped lid (2, 3) on two mutually opposing side-edges via respective, generally parallel fold lines (4, 5). The article supporting surface (1) and the lids (2, 3) together form an article enclosure. A unit closure means (22, 32) is provided for holding the packaging unit in a closed state. The two lids (2, 3) have end-walls (21, 31) and the end-walls at at least one end of the packaging unit lie adjacent one another and essentially in contact with each other when the packaging unit is closed. The unit closure means includes a groove (32) in one end-wall (31) of one lid (3), and a rib (22) in that end-wall (21) of the other lid (2) that lies adjacent the groove-containing end-wall when the packaging unit is closed, such that the rib (22) engages the groove (32) in the closed state of the packaging unit, and the rib (22) and groove (32) respectively extend from the free edge (23, 33) of their respective end-walls and have a generally straight longitudinal extension.

3 Claims, 2 Drawing Sheets

Fig. 1
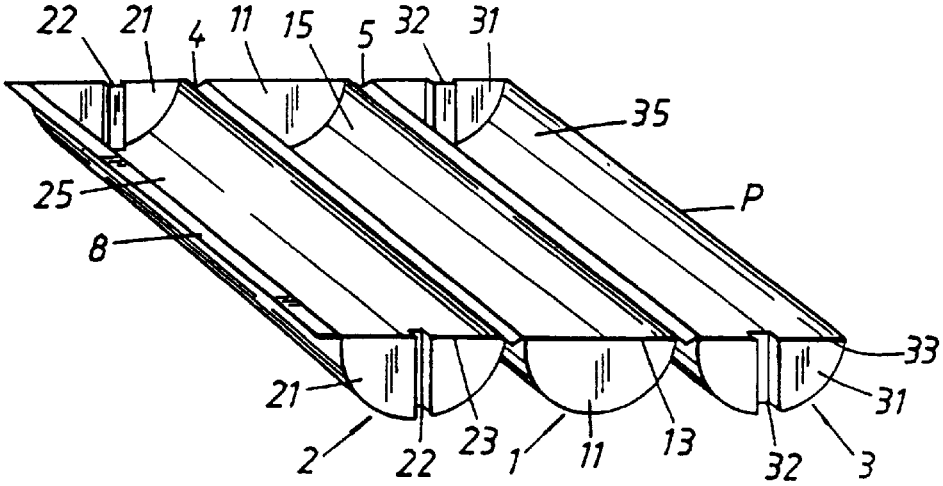
Fig. 2
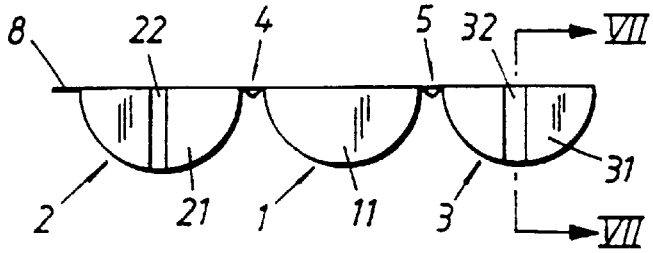
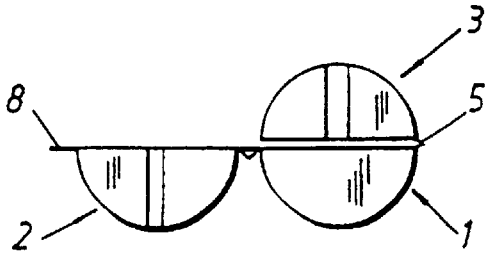
Fig. 3

PACKAGE WITH A CLOSING DEVICE

The present invention relates to a packaging unit of the kind defined in the preamble of claim 1.

It has become progressively more desirable in recent times to produce packaging units from an homogenous material, in order to facilitate recovery of the material. It is also desirable to be able to produce packaging units from thin sheet-like materials, preferably transparent materials, with integrated unit closure devices made of the same material as the unit in general, so as to enable the packaging unit to be easily latched or secured when closed and also to be readily re-opened and optionally resealed. This can be achieved with one known type of packaging unit that includes an article supporting surface that has two mutually opposing side-edges which are joined to a cupped lid or cover via respective fold lines. The two fold lines are parallel when the two lids or covers are positioned over the article supporting surface, and the article supporting surface and the lids or covers form a substantially tight article enclosure.

It is also known in practice to achieve latching of a packaging unit with the aid of a deep-drawn, convex stud on one packaging part, said stud being pressed-fitted into a corresponding recess or cut-out in an adjacent packaging part. Such a latching arrangement has a number of drawbacks, as is well known to the skilled person. A more secure latching effect could, of course, be established by providing the stud and the cut-out with undercuts, although such a solution would place unacceptably high requirements on the packaging manufacturing equipment, due to the requirement of special means for establishing undercuts and/or the packaging material must be deformed when the packaging unit is removed from the production mould.

The object of the present invention is to provide a more favourable packaging-unit closure means of the afore-described kind without needing to form undercuts in the manufacture of the packaging unit, or to form mould release means on the packaging unit or in the mould used to produce the packaging unit, so as to enable the packaging unit to be removed easily from the mould and so that the packaging unit can be latched securely and easily, and optionally also re-opened, while enabling the packaging unit as a whole to be produced advantageously from one single type of material.

This object is achieved in accordance with the invention with a packaging unit constructed in accordance with the following claim 1.

The invention can be considered to be based realising the advantages that can be achieved with a packaging unit of the aforedescribed kind when the packaging-unit closure or latching means has the form described in more detail in claim 1, with the advantages accompanying said closure means as described hereinafter.

Further embodiments of the inventive packaging unit will be apparent from the dependent Claims.

The invention has as its starting point a packaging unit that includes an article supporting surface having two mutually opposing side-edges which are joined to a cupped lid or cover via respective, generally parallel fold lines, wherewith the two lids can be folded-in over one another and over the article supporting surface so as to form an article enclosure. The two cupped lids include end-walls at their opposing ends. According to the invention, that pair of end-walls which lie in mutual abutment when the packaging unit is closed include a groove and the adjacent second end-wall has a rib. When the two lids are swung-in over one another on the article supporting surface so as to close the packaging unit, the ribs will snap into corresponding grooves, by virtue of the end-walls "yielding" elastically.

Naturally, a rib and a groove coacting therewith may be provided on each pair of end-walls of the packaging unit. Because the groove and the rib extend from the edge of the lid, the rib and the groove can both be formed without needing to provide undercuts or mould release means.

The inventive packaging unit is not limited to cupped lids nor yet to article supporting surfaces of any particular configuration, although in the illustrative embodiment the cupped lids may have cupped recesses that correspond generally to half a straight cylinder and the article supporting surface may have a correspondingly recessed shape in the form of a half straight cylinder, so that when the packaging unit is closed the packaging space have the shape of a straight cylinder. This space can be used conveniently to accommodate a row of chocolate mints for instance. When the packaging material is transparent, a person receiving the packaged mints is able to inspect the mints visually.

As indicated, the inventive packaging unit is produced by vacuum-forming a softened plastic foil in a vacuum mould. Alternatively, the packaging unit can be produced by pressing a plastic sheet between a matrix and a patrix. The packaging unit may also be injection-moulded in a mould comprising a matrix mould-half and a patrix mould-half.

The invention will now be described in more detail with reference to an exemplifying embodiment thereof and also with reference to the accompanying drawings.

FIG. 1 is a perspective view of an inventive packaging unit.

FIG. 2 is an end view of the packaging unit shown in FIG. 1.

FIGS. 3 and 4 illustrate two working steps in closing the packaging unit shown in FIG. 2.

Figure 4:
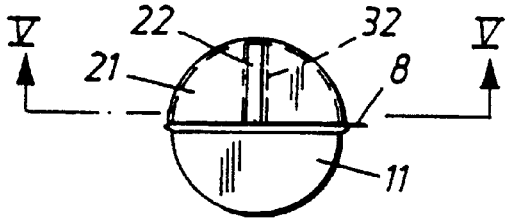

The embodiment illustrated FIGS. 1–5 is intended to tightly enclose an article that has the shape of a straight cylinder, more specifically a stack of mints. The packaging unit is comprised of a thin, sheet-like preferably transparent, plastic material which has been shaped into three main parts 1, 2, 3, each having the form of a trough intended to accommodate a respective half of the packaged article. The packaging unit parts 1 and 3 therewith are of mutually the same size in principle, whereas the packaging unit part 2 is slightly larger than the part 3 so as to be able to also accommodate the material thickness of the part 3.

Each of the parts 1, 2 3 is comprised of a respective mantle surface 15, 25 and 35, and two end-walls 11, 21 and 31 respectively. The part 2 has a flange 8 on its free long edge. The long edges of the packaging-unit parts 2 and 3 are connected to the long edges of the packaging unit part 1 via respective fold line formations 4 and 5.

The edges of the trough-shaped or cupped parts 1, 2, 3 can be considered to be in the state shown in FIG. 1, said flange 8 also protruding out in this plane.

It can be imagined that the sheet-like packaging unit shown in FIG. 1 is formed from a flat, pre-heated sheet of plastic, by being vacuum-drawn down into a mould that has the configuration illustrated in FIG. 1.

Returning now to FIG. 1, it will be seen that the end-walls 31 include a straight groove 32 which extends from the free edge of the end-wall (the plane P) generally perpendicularly to said edge. The groove 32, which can be considered to be deep-drawn in the end-wall 31, bulges inwardly of the interior of the trough-shaped part 3.

The part 2 has a rib 22 which is complementary to the groove 32 and which is formed so that when closing the packaging unit the rib can be received in the groove 32.

Figure 7:
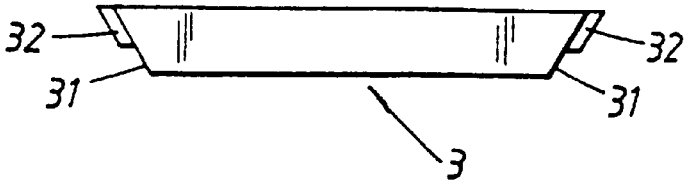
FIG. 7 is a side view of the article shown in FIG. 2.

The end-walls 21, 31 (and 11) are parallel and lie generally in a common plane (the end-wall 21 lies in a plane that borders on the plane 31). The plane of the end-walls 21, 31 defines an angle with a normal plane to the axes of the fold lines 4, 5, so that the end-walls can be released readily from the mould (see FIG. 7). The groove 32 and the rib 22 are directed so that the rib 22 will engage in the groove 32 when the part 2 is in close surface contact with the outside of the part 3.

As will be seen from FIG. 3, the part 3 is first folded back around the fold line 5 and in over the part 1, which can be said to form an article supporting surface. The part 2 is then folded in over the part 3 around the fold line such that the end-wall 21 will lie on the outside of the end-wall 31. The rib 22 will slide on the outer surface of the end-wall 31, wherewith the end-wall 31 flexes resiliently inwards while the end-wall 21 flexes resiliently outwards. When the part 2 finally makes full contact with the part 3, the rib 22 will snap into the groove 32 and therewith latch the packaging unit. The flange 8 forms a thumb grip which enables the packaging unit to be opened up, in the reverse order.

It will be evident from the aforegoing that the formations 22, 32 will preferably be made parallel as the packaging unit is formed, so as not constitute an obstruction to the release of the packaging unit from the mould, or to make such release impossible. Neither shall the packaging unit in general have any surfaces that will make release of the packaging unit from the mould difficult or impossible to achieve.

In the embodiment illustrated in FIGS. 1–5, the formations 22, 32 are directed perpendicularly to the free end-wall edges 23, 33 (which lie in the plane P), although it will be understood that the groove 32 and the rib 22 need not be perpendicular to the edges 23, 33 and need not extend up to the opposite edge of the end-wall 21, 31. Neither need the formations 22, 32 lie in the centre of respective end-walls.

Figure 6:
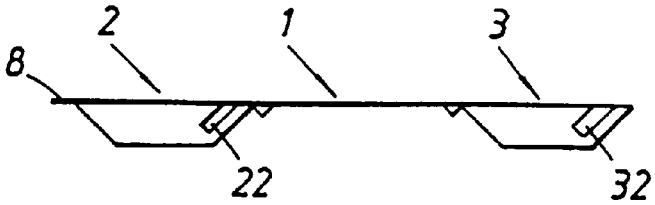
FIG. 6 illustrates another embodiment of an inventive packaging unit, in a view corresponding to FIG. 2.

FIG. 6 illustrates an embodiment in which the part 1 has the form of a generally flat article supporting surface and the packaging unit parts 2 and 3 have the form of a trough which includes flat bottoms and sloping side-walls. The end-walls are shown to lie at a small angle to a normal plane to the axes of the fold lines 4, 5, so as to enable the end-walls to be released easily from the mould. However, the end-walls may slope at a much greater angle than that shown, for instance an angle of 45° to the normal plane. It will be seen that the formations 22, 32 are parallel but not perpendicular to the plane P. It will also be seen that the formations 22, 32 do not lie at the broad centre region of the end-walls 21, 31. Neither do the formations 22, 32 extend to the bottom of the packaging-unit parts 2, 3.

In the embodiment illustrated in FIGS. 1–5, the flange 8 forms a thumb grip which facilitates opening of the packaging unit. It will also be understood, however, that the flange 8 may form an extension flap by means of which the packaging unit can be hung more easily on a display rack, said flange 8 suitably having appropriate perforations for this purpose. It will also be understood that when the flange is to be used to hang the packaging unit, it need not be provided on the free long edge of the outer packaging part 2 but may be an adjoinment to one of the end-wall edges 13 instead.

Although the embodiment shown in FIG. 1 has latching formations 22, 32 on each of the opposing ends of the packaging unit, it will be understood that it is sufficient to provide the formations 22, 32 solely at the ends of the packaging unit.

Figure 5:
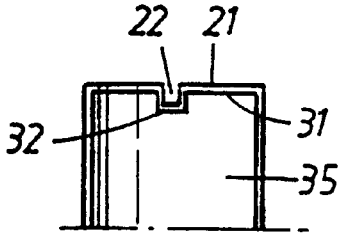
FIG. 5 is a schematic sectional view taken on the line V—V in FIG. 4.

The force with which the groove 32 and the rib 22 coact may be adapted by suitable choice of their respective cross-sectional profiles. For instance, if the groove and the rib are formed with straight angles (c.f. FIG. 5), it will be difficult to reopen the packaging unit. On the other hand, if the formations 22, 32 are given a semi-cylindrical cross-sectional shape with rounded transitions to the end-walls 21, 31, it will be much easier to reopen the packaging unit. The ease with which the packaging unit can be closed and opened will increase with an increasing slope of the end-walls to the normal plane of the fold line direction.

It will be obvious to the skilled person that the packaging unit itself, with the exclusion of the unit closure members shall be configured so as to enable the unit to be manufactured without movable mould parts and without component shapes that render release of the packaging unit from the mould difficult to achieve. The unit closure members are also shaped to fulfil these requirements, said unit closure members sliding into mutual alignment as the cupped parts of the packaging unit are swung to a closed state, and wherewith the resilience of the end-walls provides the spring effect necessary for the rib to snap into (and out of) engagement with the groove.

The invention provides a good unit latching function, despite the relatively low tolerance requirement on the formations 22, 32.

What is claimed is:

1. A packaging unit comprising an article supporting surface (1) which is joined to a cupped lid (2, 3) along two opposing side-edges via respective generally parallel fold lines (4, 5), wherewith the article supporting surface (1) and the lids (2, 3) together form an article enclosure, wherewith a unit closure means (22, 32) is provided for maintaining the packaging unit in a closed state, wherewith the two lids (2, 3) have end-walls (21, 31), and wherewith the end-walls at at least one end of the packaging unit lie adjacent one another and in general surface contact with each other when the packaging unit is closed, characterized in that the unit closure means includes a groove (32) in one end-wall (31) of one lid (3) and a rib (22) in that end-wall (21) of the other lid (2) that lies adjacent said one end-wall (31) when the packaging unit is closed, such that the rib (22) engages in the groove (32) in the closed state of said packaging unit; and in that the rib (22) and the groove (32) extend from the free edge (23, 33) of its respective end-wall and have an essentially straight longitudinal extension.

2. A packaging unit according to claim 1, characterized in that one unit closure means (22, 32) is provided on each pair of end-walls (21, 31) that lie adjacent one another when the packaging unit is closed.

3. A packaging unit according to claim 1, characterized in that the end-walls are arranged to deform elastically from their memory-shape so as to enable the rib to slide on the end-wall containing said groove and therewith snap resiliently into said groove in a terminal position.

* * * * *